United States Patent [19]

Laing

[11] 4,099,219

[45] Jul. 4, 1978

[54] CORONODE TENSIONING AND SUPPORT ARRANGEMENT

[75] Inventor: Jean Wilcox Laing, Rochester, N.Y.

[73] Assignee: Xerox Corporation, Stamford, Conn.

[21] Appl. No.: 751,827

[22] Filed: Dec. 17, 1976

[51] Int. Cl.[2] ..... H01T 19/04

[52] U.S. Cl. ..... 361/230; 55/147; 55/151

[58] Field of Search ..... 361/213, 229, 230; 250/324–328; 55/140, 147, 148, 150, 151

[56] References Cited

U.S. PATENT DOCUMENTS

| | | | |
|---|---|---|---|
| 3,501,898 | 3/1970 | Lindholm et al. | 55/147 |
| 3,789,278 | 1/1974 | Bingham et al. | 361/230 X |
| 3,908,127 | 9/1975 | Clark | 361/230 X |
| 4,020,315 | 4/1977 | Euler | 250/325 X |

FOREIGN PATENT DOCUMENTS

| | | | |
|---|---|---|---|
| 721,540 | 6/1942 | Fed. Rep. of Germany | 55/140 |

*Primary Examiner*—Harry E. Moose, Jr.

[57] ABSTRACT

A corona generating device including a coronode in the form of a wire supported between insulating end block assemblies. The coronode may take the form of a thin wire coated with a dielectric coating which may be glass or other suitable material, the coating being formed into enlarged beads adjacent the ends thereof. The coronode beads rest jointly on the floors of the cavities provided in each end block assembly and may also be supported on a thin pedestal or elongated support which spans the end block assemblies. The pedestal serves as a continuous support for the coronode intermediate the end block assemblies. One end block assembly includes a member movable into abutment with the bead to apply an adjustable tensioning force to the coronode.

7 Claims, 4 Drawing Figures

CORONODE TENSIONING AND SUPPORT ARRANGEMENT

BACKGROUND OF THE INVENTION

This invention relates to electrostatography. More particularly, this invention relates to corona generating devices for applying electrostatic charge onto a suitable surface.

In the electrostatographic process, an electrostatographic plate comprising a photoconductive insulating material on a conductive backing is given a uniform electric charge over its surface and then is exposed to the subject matter to be reproduced usually by conventional projection techniques. This exposure discharges the plate areas in accordance with the radiation intensity which reaches them and thereby creates an electrostatic latent image on or in the plate coating which may then be developed into visible form by applying a developer material, e.g., a powder, to the plate using any one of a number of development techniques generally known and used in the art. The developer material electrostatically clings to the plate in a visual pattern corresponding to the electrostatic image. Thereafter the developed image is usually transferred from the plate to a support material such as paper to which it may be fixed by any suitable means thereby forming a permanent print.

Instead of being developed by means of a powder, the electrostatic latent image may also be developed by using liquid development techniques also well known in the art.

The charging of the electrostatographic plate in preparation for the exposure step can be accomplished by means of a corona generating device whereby electrostatic charge is applied to the electrostatographic plate to raise it to a potential of approximately 500 to 600 volts. One form of a corona generating device for this purpose is disclosed in U.S. Pat. No. 2,777,957 wherein a plurality of parallel wires are connected in series to a high voltage source and are supported in a conductive shield that is arranged in closely spaced relation to the surface to be charged. When the wires are energized, corona is generated along the surface of the wires and ions are caused to be deposited on the adjacent photoconductive surface. Suitable means are usually provided to effect relative movement of the surface to be charged and the corona generating device.

It is important that the coronode in the above arrangements be maintained in a condition in which each point along its surface is equidistant from the surface to be charged since variations in this distance will result in non-uniformity of the charge applied to the surface, usually the electrostatographic plate. In order to ensure that the coronode is maintained in horizontal plane equispaced from the imaging surface, it has heretofore been proposed to connect the coronode wires to at least one of the end mountings by means of a tension spring. This has the desirable feature of enabling the wires to be mounted in the device under tension while reducing the possibility of the wires, which are extremely fine (generally of the order of 0.004 inch thick), being stretched beyond their elastic limit during asembly.

It is also desirable in corona generating devices to provide an arrangement for easily replacing a deteriorated coronode or corona electrode with a new one. Since this replacement usually takes place at a commercial site of a machine by a service technician, ease of replacement and adjustment in a minimum amount of time is essential.

In addition, as disclosed in copending application Ser. No. 595,656, filed in the joint names of T. Davis and G. Safford, it has been noted that outstanding charging characteristics are obtainable for xerographic charging by the use of a coronode in the form of a thin wire coated with thick dielectric coating. In such an arrangement, a corona generating A.C. voltage is applied to the wire and a D.C. bias voltage is applied to an adjacent conductive plate to produce a charge control field. Since the details of the coronode and the arrangement for applying corona generating and control voltages thereto form no part of this invention, incorporation by reference of the details disclosed in that application is hereby made.

In addition, as contracted with prior art coronodes in which tension has been applied to a wire member it has been found desirable in coronodes of the type disclosed in application Ser. No. 595,656 to apply the tension to the outer dielectric coating rather than to the inner wire conductor. This latter type of arrangement has the advantage that a wire of less tensile strength may be employed, thereby reducing the cost of the coronode.

In addition, it has been found that the cobmined action of a continuous support for the coronode and a concurrent tensioning of the dielectric coating gives improved performance while facilitating assembly of the device.

When using coronodes of the type disclosed in Ser. No. 595,656 the problems noted above experienced with conventional coronodes become even more acute. Specifically, there is a need to put a tension on the coronode to hold it in a preselected position with respect to the surface to be charged. But since the coronode is comprised of a thin outer coating of a brittle dielectric material, such as glass, it is easily fractured. Thus, in handling the coronode for insertion into the end supports of the corona device it is easy to crack or split the outer sleeve which results in a consequent irregularity in the charge delivered by the device to an imaging surface.

OBJECTS & SUMMARY OF THE INVENTION

A primary object of this invention therefore is the provision of a corona discharge electrode configuration and complementary support structure designed to operate in accordance with the teaching of aforementioned application Ser. No. 595,656.

A further object is the provision of a corona device having a coronode comprised of a wire covered with a dielectric coating and means for tensioning the coronode by the application of a force or bias to the coating rather than the wire.

A still further object of this invention therefore is the provision of a corona device in which the entire length of the coronode is supported on a thin member spanning the end block assemblies while a tensioning force is concurrently applied to the dielectric coating portion of the coronode.

The above-noted objects and others are accomplished, according to the invention, by a corona generating device including a coronode in the form of a wire supported between insulating end block assemblies. The coronode comprises a thin elongated conductor covered with a dielectric coating which may be glass or other suitable material, the coating being formed in the shape of enlarged beads adjacent the ends thereof. Means are provided for applying a tensioning force to the coating to hold it a preselected distance above an imaging surface. The tensioning means comprises a movable member slidable into abutment with one of the beads found on the coronode. The coronode beads rest jointly on the floors of the cavities provided in each end block assembly and in addition, the body of the coronode may be supported on a thin pedestal or elongated support which spans the end block assemblies. The pedestal serves as a continuous support for the coronode intermediate the end block assemblies.

Each assembly is constructed of mating approximate half-sections which jointly define a substantially closed and insulated cavity into which the beads are inserted. High voltage is coupled electrically to the coronode via a high voltage terminal and a conductive fastener which clamps to the wire on one end thereof.

BRIEF DESCRIPTION OF THE DRAWINGS

In order that the invention may be more readily understood, reference will now be made to the accompanying drawings, in which.

DESCRIPTION OF THE PREFERRED EMBODIMENT

Figure 1:
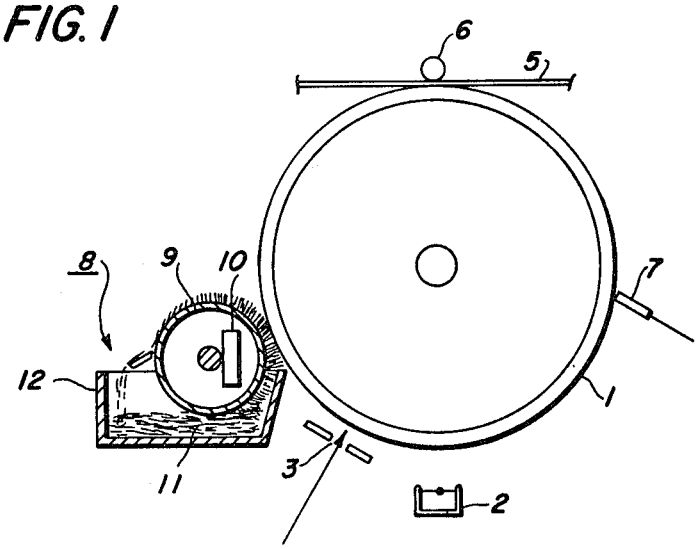
FIG. 1 is a schematic cross-section illustrating the operation of one embodiment of electrostatographic reproduction machine incorporating a corona generating device of this invention.
Figure 3:
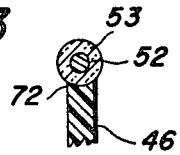
FIG. 3 is a sectional view taken on the line 3—3 of FIG. 2.
Figure 4:
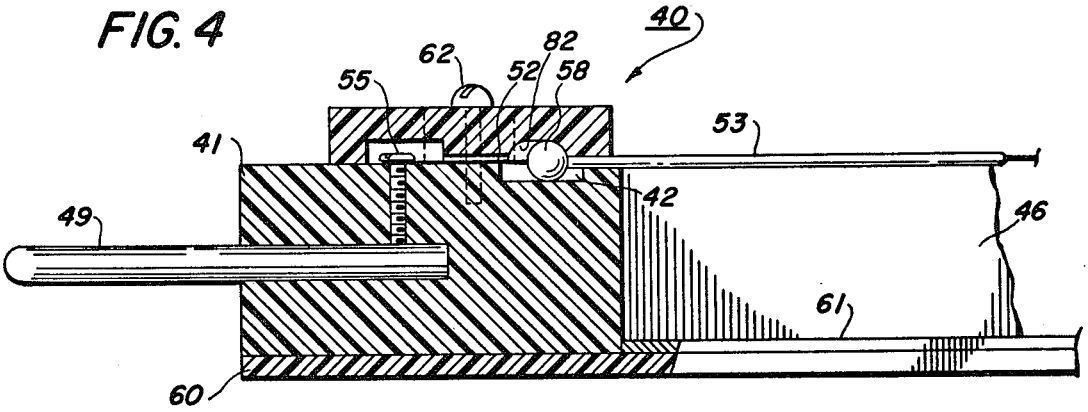
FIG. 4 is a sectional view taken along the line 4—4 of FIG. 2.

As a background, an electrostatographic machine of the type incorporating corona devices according to this invention will first be described with reference to FIG. 1. A moving photoconductive plate, in this instance having an endless surface constituting the periphery of a drum 1, is first uniformly charged at a charging station 2 by a corona generating device of the type disclosed herein and the surface then exposed at an exposure station 3 to a light pattern of the image sought to be reproduced thereby to discharge the charge in the area where light strikes the plate surface. The undischarged areas of the surface thus forms an electrostatic charge pattern in conformity with the configuration of the original image pattern.

The electrostatic latent image is then developed into visible form by the development system 8 of the magnetic brush type which is well known in the art. Subsequent to the development operation the now visible image is transferred from the plate to a sheet of final support material 5, such as paper or the like, thereby to form a permanent print, at a transfer station in accordance with the present invention schematically illustrated at 6. The paper or the like is fed to the transfer station by means (not shown) programmed to deliver the paper in synchronism with the arrival of the developed image.

Following transfer, residual developer remaining on the plate surface is removed by a cleaning blade 7 and collected for subsequent disposal. The plate is then further discharged or erased to a residual voltage prior to a further electrostatographic cycle.

The development system 8 of the illustrated embodiment employs a magnetic brush applicator including a non-magnetic sleeve 9 which rotates about a stationary magnet 10. The magnet serves to create a field which in conjunction with the sleeve moves ferromagnetic developer powder 11 from a storage sump 12 into contact with the plate.

Other development systems are well known in the art and may be utilized with equal success in such reproduction machines.

It is to be understood, as noted hereinbefore, that any kinks or slackness of the wire coronode in the charging device 2 will lead to non-uniform charging of the electrostatographic plate. Slackness also results in non-uniform spacing of the wire from the plate surface and increases the chances of vibrations being set up in the wire while it is operating. In order to alleviate the problem of non-uniform charging due to these causes, an arrangement is provided to maintain the coronode in a horizontal plane so that the distance between any point along its length and the imaging surface is constant.

Figure 2:
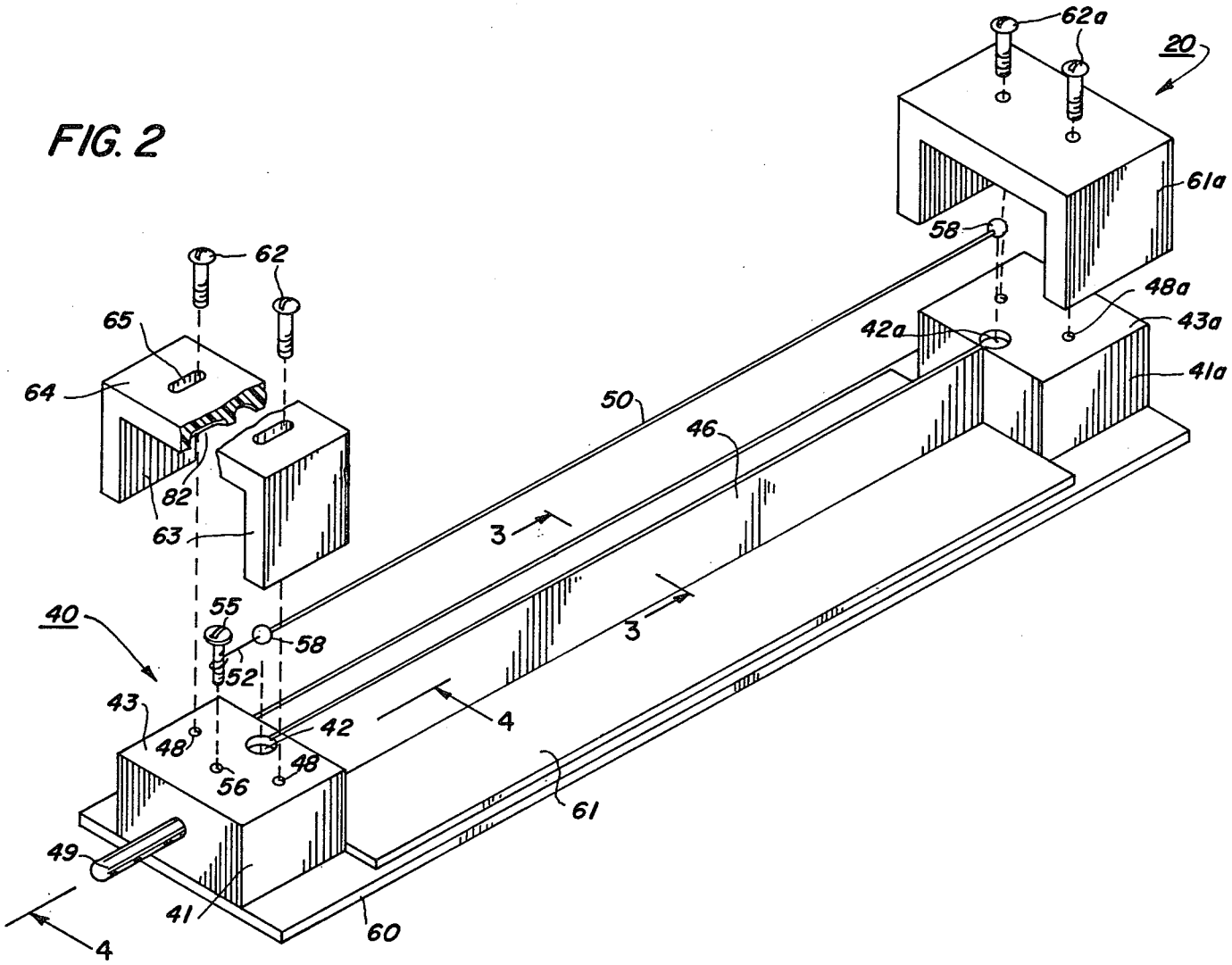
FIG. 2 is a perspective view of one embodiment of corona generating device according to the invention partially broken away for clarity.

Referring now to FIG. 2, the invention is seen to comprise a coronode 50 supported between insulating end block assemblies 20 and 40.

The coronode 50 consists of a thin wire 52 coated with a dielectric sleeve 53. The sleeve must be sufficiently thick so as to prevent the flow of conduction current therethrough and may be made of glass or ceramic material. The method of energizing and controlling the charge output of coronode 50 to produce a usable corona discharge and other suggested materials for the coronode are disclosed in detail in the aforementioned copending application Ser. No. 595,956 to which reference has been made hereinbefore.

The outer sleeve 53 is formed into the shape of enlarged masses or beads 58 adjacent the ends thereof. These beads 58 are preferably made of the same material as the outer sleeve 53 and formed onto the wire 52 during the same process. However, where the outer sleeve is glass, the beads may be fused or melted onto the ends of the sleeve. Any suitable process of forming these beads may be employed. It is noted that on the end of the coronode 50 to which high voltage is to be attached via the terminal 49, the wire 52 extends through the bead 58 so as to provide a surface area of connection for the high voltage. While the beads 50 are shown as being spherical in shape any one of a variety of shapes may be employed taking into consideration the overall purpose of the beads as explained in greater detail hereinbefore.

The assemblies 20 and 40 are held a fixed distance apart by means of a rigid insulating support plate 60 to which the assemblies may be fastened by conventional means such as insulating screws (not shown). The end block assemblies 20 and 40 are extruded of a high dielectric strength insulator such as ceramics, glass, polyvinylchloride or nylon. In view of the similarity between the end block assemblies only assembly 40 will be described in detail and corresponding elements in assembly 20 will be given the same reference numerals, but with the suffix "*a*" added.

The assembly 40 permits connection to a high voltage supply for application of a corona generating potential to one end of the coronode 50. It comprises two part-sections 41 and 61 which are held together in mating relationship by means of a pair of screws 62 or other similar fastening devices. If the screws 62 are made of a conductive material, they are located far enough away from the other conductive parts (and voltage applied thereto) of the assembly so as not to provide a potential corona forming surface. Alternately, the screws may be made of a suitable dielectric, such as nylon.

The lower part-section 41 is generally rectangular in shape and includes a cavity 42, shown as circular in cross-section, which extends from the top surface 43 of the section 41 to a depth suitable for support of the coronode 50 jointly on the floor thereof and on a insulative pedestal 46, as will be described in greater detail hereinafter. A plurality of internally threaded recesses 48 are provided in the part-section 41 into which the screw 62 pass.

The floor of the cavity 42 may have a slightly concave shape or may alternately be generally flat. The diameter of the cavity 42 is selected to be a little larger than the diameter of the bead, so as to permit a slight degree of outward movement of the bead in the direction parallel to the longitudinal dimension of the coronode.

A terminal or conductive projection 49 passes from the exterior of the part-section 41 through a portion thereof and intersects a threaded recess 56 into which a conductive screw 55 is inserted. The screw 55 when threaded into the recess 56 abuts the interior portion of terminal 49.

The upper part-section 61 of the end block assembly 40 generally comprises an inverted U-shaped member. The legs 63 of the U extend toward and straddle the lower part-section 41 and the base 64 of the U serves as an insulative cap or cover for the exposed conductive elements of the lower part-section 41. The wall of the section 61 facing the section 41 includes a depression or dimple 82 which has a generally concave inner surface which complements and abuts the outer surface of the bead 58. The slots 65 through which the screws 62 pass are elongated to permit adjustment of the position of the upper part-section 61 relative to the lower part-section 41 so as to apply a tension force to the bead 58 and coronode 53 in a direction outwardly of the device along the longitudinal axis of the coronode.

A support member 46 in the form of a thin elongated plate is arranged in an upstanding configuration to span the distance between the end block assemblies 20 and 40. The topmost face 72 of the member 46 may be made convex in shape to better complement the outer surface of the coronode 50 and thereby provide a more stable support therefor. The member 46 is made of an insulative material and the ends thereof are coupled to each of the end block assemblies in any conventional fashion. As shown, the member 46 interfits into recesses in the walls of the part-sections 41 and **41*a* adjacent the cavities 42. The height of the member 46 is selected to support the coronode along a preselected plane and in cooperation with the floor or base of the cavities 42 and 42*a***.

A conductive control plate 61 is located between the assemblies 20 and 40 and biased to a preselected voltage to control the magnitude and polarity of charge delivered by the corona device to the adjacent surfaces in accordance with the teachings of the aforementioned copending application.

To assemble the corona support structure of this invention, the beads 58 are simultaneously inserted into the cavities 42 and **42*a* so that the beads rest on the floors of the cavities and the body of the coronode rests on the top surface of the support pedestal 61. The end of the wire 52 extending out of the bead on the high voltage side of the coronode 50 is wound underneath the head of the screw 55, which is then threaded into the recess 56 until contact is made with the terminal 49**.

The upper part-sections **61*a* is then fastened to the lower part-section 41*a* by means of the screws 62*a* and tightened in place. Before tightening the screws 62, the upper part-section 61*a* is moved or slid outwardly of the device along the axis of the coronode to place a tension force on the coronode by abutment between the inner walls of the depression 82 and the bead 58, the bead on the opposed end of the coronode being held firm by abutment with the walls of the cavity 42*a*. The relative movement of the section 61 and the lower section 41 is made possible by the elongated slots 65 in the upper section 41**.

The assembled unit is then inserted into the reproduction machine in such a manner that a suitable high voltage corona generating voltage is coupled to the terminal 49 and a suitable control voltage is coupled to the plate 61 in accordance with the teaching of the aforementioned copending application.

While the invention has been described in connection with a specific examplary embodiment thereof, it will be understood that many modifications will be readily apparent to those of ordinary skill in the art; and that this application is intended to cover any adaptations or variations thereof. Therefore, it is manifestly intended that this invention be only limited by the claims the equivalents thereof.

What is claimed is:

1. A corona discharge device comprising a coronode including a wire coated with a dielectric material, and means for applying a tension force directly to said dielectric material to aid in supporting said coronode.

2. The combination recited in claim 1 including end block assemblies for supporting opposed ends of said coronode, said coronode having an enlarged mass carried by said material adjacent one end thereof, at least one of said assemblies including means movable into abutment with said mass to provide apply a preselected tension thereto.

3. The combination recited in claim 2 wherein said mass is made of the same material as said coating.

4. The combination recited in claim 2 wherein said at least one assembly comprises cooperating part-sections, one section being stationary and having an opening into which said mass interfits, said other section being slidable relative to said one section while in abutment with said mass.

5. The combination recited in claim 1 further including assemblies for supporting opposed ends of said coronode and a member extending between said assemblies for directly supporting portions of said coronode intermediate therebetween.

6. The combination recited in claim 5 wherein said member comprises a thin upstanding wall, arranged in a plane running parallel to said coronode.

7. The combination recited in claim 5 wherein said member extends substantially the entire length of said coronode between said assemblies.

* * * * *

REEXAMINATION CERTIFICATE (60th)

United States Patent [19]

Laing

[11] B1 4,099,219

[45] Certificate Issued Mar. 15, 1983

[54] CORONODE TENSIONING AND SUPPORT ARRANGEMENT

[75] Inventor: Jean Wilcox Laing, Rochester, N.Y.

[73] Assignee: Zerox Corporation, Stamford, Conn.

Reexamination Request

No. 90/000,112, Nov. 19, 1981

Reexamination Certificate for:

| | |
|---|---|
| Patent No.: | **4,099,219** |
| Issued: | **Jul. 4, 1978** |
| Appl. No.: | **751,827** |
| Filed: | **Dec. 17, 1976** |

[51] Int. Cl.[3] ..... H01T 19/04

[52] U.S. Cl. ..... 361/230; 55/147; 55/151

[58] Field of Search ..... 361/229, 230

*Primary Examiner*—Harry E. Moose, Jr.

*Attorney, Agent or firm*—John E. Beck; Joseph R. Sakmyster; Ronald Zibelli

[56] References Cited

U.S. PATENT DOCUMENTS 4,086,650 4/1978 Davis et al. ..... 361/229

FOREIGN PATENT DOCUMENTS 1404895 9/1875 United Kingdom.

[57] ABSTRACT

A corona generating device including a coronode in the form of a wire supported between insulating end block assemblies. The coronode may take the form of a thin wire coated with a dielectric coating which may be glass or other suitable material, the coating being formed into enlarged beads adjacent the ends thereof. The coronode beads rest jointly on the floors of the cavities provided in each end block assembly and may also be supported on a thin pedestal or elongated support which spans the end block assemblies. The pedestal serves as a continuous support for the coronode intermediate the end block assemblies. One end block assembly includes a member movable into abutment with the bead to apply an adjustable tensioning force to the coronode.

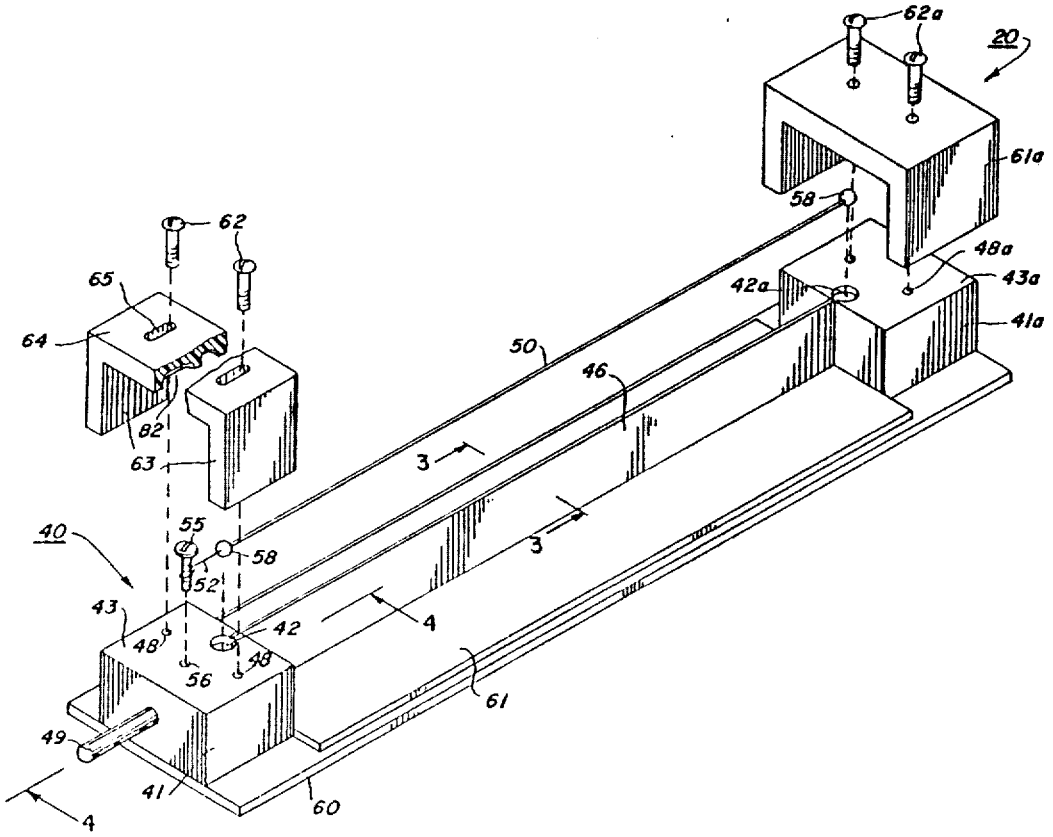

REEXAMINATION CERTIFICATE ISSUED UNDER 35 U.S.C. 307.

THE PATENT IS HEREBY AMENDED AS INDICATED BELOW.

Matter enclosed in heavy brackets appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claims 1, 3 and 4 determined to be patentable as amended:

1. A corona discharge device comprising a coronode including a wire coated with a dielectric material, and means for applying a tension force directly to said dielectric material to aid in supporting said coronode[.], *said means including end block assemblies for supporting opposed ends of said coro- node, said coronode having an enlarged mass carried by said material adjacent one end thereof, at least one of said assemblies including means movable into abutment with said mass to provide apply a preselected tension thereto.*

3. The combination recited in claim [2] *1* wherein said mass is made of the same material as said coating.

4. The combination recited in claim [2] *1* wherein said at least one assembly comprises cooperating part-sections, one section being stationary and having an opening into which said mass interfits, said other section being slidable relative to said one section while in abutment with said mass.

Claims 5–7, dependent on amended claims, are determined to be patentable.

* * * * *